US008431310B2

(12) United States Patent
Shirai et al.

(10) Patent No.: US 8,431,310 B2
(45) Date of Patent: Apr. 30, 2013

(54) IMAGE FORMING METHOD

(75) Inventors: Aya Shirai, Tokyo (JP); Tatsuya Nagase, Tokyo (JP); Motoi Nishimura, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 408 days.

(21) Appl. No.: 12/758,185

(22) Filed: Apr. 12, 2010

(65) Prior Publication Data

US 2010/0266946 A1 Oct. 21, 2010

(30) Foreign Application Priority Data

Apr. 15, 2009 (JP) ..... 2009-098763

(51) Int. Cl.
*G03G 9/00* (2006.01)

(52) U.S. Cl.
USPC ..... 430/110.3; 430/110.1; 430/123.5

(58) Field of Classification Search ..... 430/108.1, 430/110.1, 110.3, 123.5
See application file for complete search history.

(56) References Cited

U.S. PATENT DOCUMENTS 6,677,097 B2 * 1/2004 Ohmura et al. ..... 430/110.3
2009/0017395 A1 * 1/2009 Ariyoshi et al. ..... 430/111.4

FOREIGN PATENT DOCUMENTS

JP 2002351144 12/2002
JP 2004061822 2/2004

* cited by examiner

*Primary Examiner* — Stewart Fraser
(74) *Attorney, Agent, or Firm* — Lucas & Mercanti, LLP

(57) ABSTRACT

A color particle is disclosed, comprising a color-exhibitive piece which comprises microparticles for structural color and a matrix and is dispersed in a binder resin, wherein the color particle meets the following requirement:

$$1.5 \leqq A/B \leqq 5.0$$

wherein A is a major axis diameter of the color particle and B is a minor axis diameter of the color particle; and an angle of a longitudinal direction of the color-exhibitive piece to a major axis direction of the color particle falls within a range of ±20 degrees.

10 Claims, 3 Drawing Sheets

IMAGE FORMING METHOD

This application claims priority from Japanese Patent Application No. 2009-098763, filed on Apr. 15, 2009, which is incorporated hereinto by reference.

FIELD OF THE INVENTION

The present invention relates to an image forming method by using colored particles exhibiting a structural color.

BACKGROUND OF THE INVENTION

There has been a desire for preparation of notes for invitation to a home party, a small-scaled store flyer or advertisements by a full-color printer. Also there has been desired special colors rich in decorativeness, such as a special color in which different colors are visible depending on the viewing angle, for example in an opal. To represent such a structural color, there was proposed an image forming material containing an interference pigment such as, for example, pearl mica, as described in, for example, Japanese Patent Application Publication JP 2002-351144A and 2004-061822A.

In such as an interference pigment, different colors are visible depending on the viewing angle and to allow a specific color to be visible at a specific angle, it is necessary to make the fixing direction of the individual interference pigment uniform; however, control in such a direction has been difficult in the prior art. Accordingly, there were produced problems such that a color visible at a specific angle became varied, rendering it difficult to have control to view a specific color at a specific angle.

SUMMARY OF THE INVENTION

The present invention has come into being in view of the foregoing circumstances and it is an object of the invention to provide an image forming method capable of forming an image in which a specific color is visible at a specific angle.

One aspect of the invention is directed to a color particle comprising a color-exhibitive piece which comprises microparticles for structural color and a matrix and is dispersed in a binder resin, wherein the color particle meets the following requirement:

$$1.5 \leqq A/B \leqq 5.0$$

wherein A is a major axis diameter of the color particle and B is a minor axis diameter of the color particle; and an angle of a longitudinal direction of the color-exhibitive piece to a major axis direction of the color particle falls within a range of ±20 degrees.

In the color particle, the major axis diameter (A) of the color particle is preferably from 1 to 100 μm.

The color particle contains the color-exhibitive particle, preferably in an amount of 0.1 to 50% by mass.

In the color particle, the color-exhibitive piece has a major axis diameter (a) of 1 to 75 μm and a minor diameter (b) of 0.5 to 50 μm.

In the color particle, preferably, a colorant is dispersed in the binder resin of the color particle.

Another aspect of the invention is directed to an image forming method comprising forming an image by the use of a color particle, as described above.

In the image forming method of the invention, a color particle which contains a color-exhibitive piece exhibiting a structural color inclined at a specific angle and exhibits anisotropy, is used, whereby enhanced uniformity of the fixing direction of the color-exhibitive piece is achieved in the obtained image, wherein different colors are visible depending on the viewing angle, and there can be formed an image in which a specific color is visible at a specific angle.

DETAILED DESCRIPTION OF THE INVENTION

The present invention will be described in detail.

In the invention, image formation is performed by using a color particle in which a color-exhibitive piece exhibiting a structural color and composed of at least particles used for the structural color and a matrix is dispersed in a binder resin in the state of being inclined at a specific angle. Specifically, there is cited a preferred example of an image forming method in which a particulate image is formed with color particles on an image supporting material and then, the particulate image is fixed by a heating treatment (hereinafter, also denoted as a heat-fixing method).

Color Particle

Figure 1:
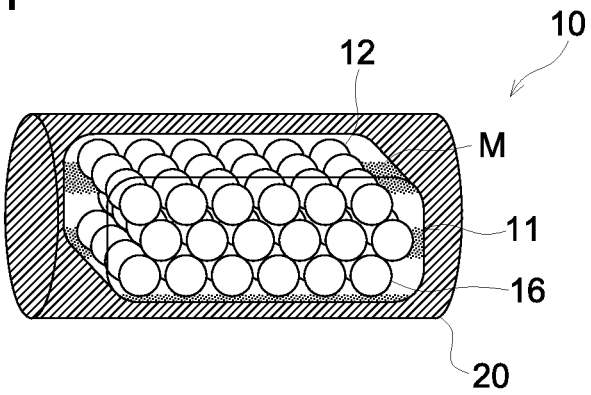
FIG. 1 illustrates a schematic perspective view showing an example of the structure of a color particle used in the invention.
Figure 2:
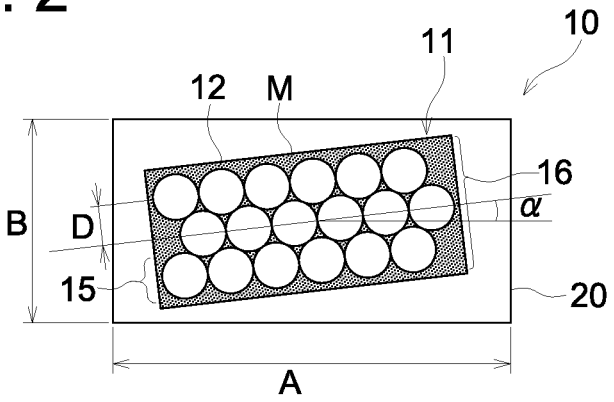
FIG. 2 illustrates a schematic sectional view showing a section of a color particle.

FIG. 1 illustrates a schematic perspective view showing an example of the structure of a color particle used in the invention. FIG. 2 illustrates a schematic sectional view showing the section of a color particle.

A color particle 10, as used in the invention comprises a color-exhibitive piece 11 exhibiting a structural color and dispersed within a fixing layer 20 composed of at least a binder resin. The color particle 10, to which after-treatment agents are added to improve characteristics such as fluidity or electrification property, may be employed for image formation by an electrophotographic process.

The color particle 10 preferably contains the color-exhibitive piece 11, preferably in an amount of 0.1 to 50% by mass. In the color particle 10, the content of the color-exhibitive piece 11, falling with the foregoing range does not hinder thermal deformation of a binder resin in fixing, even when applied to a heat-fixing method, rendering it feasible to obtain an image with no defects. On the contrary, a content of the color-exhibitive piece 11 of less than 0.1% by mass may make it difficult to an image exhibiting a structural color with a desired luminance and a content of the color-exhibitive piece 11 of more than 50% by mass could require a larger amount of thermal energy in fixing when applied to a heat-fixing method.

Specifically, the number of color-exhibitive pieces (11) contained in one color particle (10) may be at least one and there may be contained plural particles (11).

The color particle 10 used in the invention is in an anisotropic form having a major axis and a minor axis. Specifically, as shown in, for example, FIG. 1, it may be in a cylindrical form.

Figure 6A:
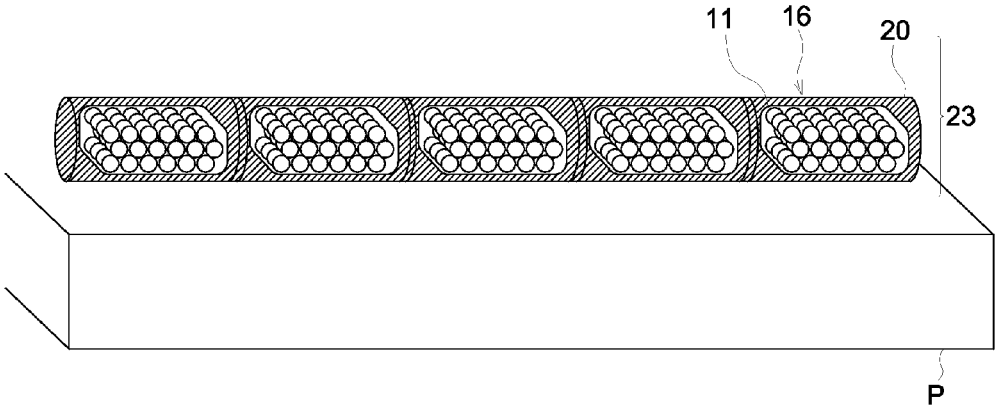
FIGS. 6*a* and 6*b* illustrate the case of employing a heat-fixing method, as an example of an image forming method of the invention.

The ratio of major axis diameter (A) to minor axis diameter (B) of the color particle, A/B is in the range of $1.5 \leqq A/B \leqq 5.0$, and preferably $2.5 \leqq A/B \leqq 4.0$. When the ratio of major axis diameter (A) to minor axis diameter (B), A/B of the color particle falls within the foregoing range, appropriate anisotropy in shape is achieved. Accordingly, in an obtained image or in a particulate image 23 (as shown in FIG. 6*a*) before being heated when applying a heat-fixing method, uniformity in a fixing direction of color particles (10) is enhanced, resulting in enhanced uniformity in a fixing direction of color-exhibitive pieces (11) in the obtained image. When the ratio of major axis diameter (A) to minor axis diameter (B), A/B of the color particle is less than 1.5, anisotropy in shape of a color particle becomes small and enhanced uniformity in a fixing direction of color particles (10) cannot be achieved in an obtained image or in a particulate image 23 before being heated when applying a heat-fixing method.

The major axis diameter (A) and minor axis diameter (B) can be measured in the following manner.

A two-component developer composed of a mixture of a carrier and color particles (10) is placed with being vibrated between aluminum parallel plate electrodes, on the upper surface of which a polyethylene terephthalate (PET) sheet (Lumilar S10, produced by TORAY) is adhered. The colored particles (10) are placed on the PET sheet by subjecting the colored particles to development under conditions of a gap between electrodes of 0.5 mm, a DC bias of 1.0 kV, an AC bias of 4.0 kV and 2.0 LHz, and then embedded in an epoxy resin together with the PET sheet. Ultra-thin slices are prepared along the face parallel to the substrate by using an ultramicrotome (EM UCG, made by Leica Co.) at an acceleration voltage of 200 kV and a set thickness of 100 nm. The section of the thus prepared slice was photographed by a transmission electron microscope (2000EX, made by Nippon Denshi Co., Ltd.) at a magnification so that an area ratio of a colored particle (10) to a frame area of electronmicrograph (TEM) was 2%. From the thus obtained tomographic picture, 100 colored particles (10) were measured with respect to major axis diameter and minor axis diameter by using an image processor (RUZEX IID, made by NIRECO Co.) The major axis diameter (A) and the minor axis diameter (B) were each represented by a number average value.

The major axis diameter refers to a maximum diameter of colored particles (10) in the photographic image and the minor axis diameter refers to the maximum length of diameters perpendicular to a major axis diameter. When sandwiching in a photographic image of a colored particle (10) between two parallel lines, the maximum diameter refers to the width of a colored particle exhibiting a maximum distance between parallel lines.

The major axis diameter (A), which may be different depending on a specific image forming method such as an electrophotographic method, a powder coating method or the like, is preferably from 1 to 100 μm, and more preferably from 5 to 30 μm.

Color-Exhibitive Piece

A color-exhibitive piece (11) is included in a color particle (10) in such a state that an angle (α) of the longitudinal direction of the color-exhibitive piece (11) to the major axis direction of the color particle (10) falls within a range of ±20 degrees (from −20 to +20 degree) and preferably ±10 degrees (from −10 to +10 degree). Such an angle which the longitudinal direction of the color-exhibitive piece (11) makes to the major axis direction of the color particle (10) is also called an included angle. Thus, color-exhibitive piece (11) is included at such an included angle in the color particle (10), as shown in FIG. 2.

An included angle of a color-exhibitive piece (11) falling within the foregoing range results in enhanced uniformity of the fixing direction of the color-exhibitive piece (11), whereby different colors are visible depending on the viewing angle, and there can be formed an image in which a specific color is visible at a specific angle.

The included angle (α) of a color-exhibitive piece (11) is measured similarly to the above-described measurement of the major axis diameter (A) and the minor axis diameter (B) of a color particle (10). An ultra-thin slice is prepared and its tomographic picture is analyzed. Angles of the major axis diameter direction of a color-exhibitive piece (11) included in a color particle (one which is maximum in major axis diameter in the case when plural color-exhibitive pieces are included) to the direction of the major axis direction of a color particle (10) are measured and their number average value represents an included angle (α) of a color-exhibitive piece (11).

The major axis diameter refers to a maximum diameter of the subject material in the photographic image. When sandwiched in a photographic image of a colored particle (10) between two parallel lines, the maximum diameter refers to the width of a colored particle exhibiting a maximum distance between parallel lines.

With respect to a specific size of a color-exhibitive piece (11), the major axis diameter (a) is preferably from 1 to 75 μm, and more preferably from 10 to 30 μm; the minor axis diameter (b) is preferably from 0.5 to 50 μm, and more preferably from 5 to 15 μm.

The major axis diameter (a) and minor axis diameter (b) of a color-exhibitive piece (11) are measured in the same manner as in the major axis diameter (A) and minor axis diameter (B) of the foregoing color particle (10), except that the color particle (10) is replaced by the color-exhibitive piece (11).

The color-exhibitive piece (11) constituting the color particle (10) is comprised of a periodic structure (16) formed in a matrix M and a chromatic color is visible upon exposure to visible light through formation of such a periodic structure in the color-exhibitive piece (11).

Specifically as shown in FIG. 2, for example, the color-exhibitive piece (11) exhibits a structure in which solid microparticles (12) for structural color are regularly arranged in the planar direction with being in contact with each other to form a particle layer (15), while the microparticles (12) are also in contact with each other in the thickness direction.

Figure 3:
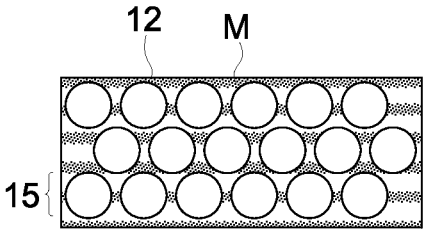
FIG. 3 illustrates a schematic sectional view showing an example of a color-exhibitive piece used in the invention.

Alternatively, for example, in the case of the matrix being solid, the solid microparticles (12) for structural color may regularly be arranged in the planar direction with not being in contact with each other to form a particle layer (15), while the microparticles (12) are also in a non-contact state with each other in the thickness direction, as shown in FIG. 3.

The particle layer (15) formed of particles for structural color has a structure in which the microparticles (12) for structural color are regularly arranged in a single direction to the direction of incident light. Specifically, it is preferred that the solid microparticles (12) are arranged so as to form a close-packed structure, such as a cubic close-packed structure or hexagonal close-packed structure.

In the color-exhibitive piece (11), an absolute value of a difference in refractive index between microparticles (12) for structural color and matrix M (which is hereinafter also called refractive index difference) is preferably from 0.02 to 2.0, and more preferably from 0.1 to 1.6.

In cases when the matrix is air and the material to form a fixing layer (20) is applied to the heat-fixing process and exhibits a characteristic such that it melts by heating at the time of fixing and fills spaces between microparticles (12)

forming the color-exhibitive piece (11), the difference in refractive index between microparticles (12) for structural color and a resin to form the fixing layer (20) may fall within the range described above. Further, in cases when a material forming a matrix M and a binder resin forming the fixing layer (20) are compatible with each other, the difference in refractive index between a compatible substance and the microparticles (12) for structural color may fall within the range described above.

A difference in refractive index of less than 0.02 renders it difficult to exhibit structural color and a difference in refractive index of more than 2.0 results in greatly increased light scattering, exhibiting a milky white structural color and rendering the exhibited color difficult to be recognized.

The thickness of the particle layer (15) in the color-exhibitive piece (11) is preferably from 0.1 to 100 μm. A thickness of the particle layer (15) of less than 0.1 μm results in diluted structural color, while a thickness of more than 100 μm results in increased light scattering, exhibiting a milky white structural color and rendering the exhibited color difficult to be recognized.

The periodicity of the particle layer (15) in the color-exhibitive piece (11) at least one, and preferably from 5 to 500. When a periodicity is less than 1, the obtained color-exhibitive piece (11) exhibits no structural color.

In an image obtained in the image forming method of the invention, an exhibited color by structural color is a color having a peak wavelength within a visible range.

In the color-exhibitive piece (11), an interlayer distance D (or a distance between nearest layers) is preferably from 50 to 500 nm. When the interlayer distance falls within the foregoing range, the structural color exhibited in the color-exhibitive piece (11) is an exhibitive color having a peak wavelength in the visible range. On the contrary, when the interlayer distance is more than 500 nm, there is a concern that the obtained color-exhibitive piece (11) exhibits no structural color.

Structural Color

The structural color obtained in the color-exhibitive piece (11) is not a color due to light absorption by a dye or the like but a color exhibited by selective light reflection due to a periodic structure or the like and includes one due to thin-layer interference, light scattering (Rayleigh scattering, Mie scattering), multi-layer interference, diffraction, diffraction grating, a photonic crystal and the like.

The color-exhibitive piece (11) has a structure capable of reflecting light by the color-exhibitive piece (11) and the exhibited structural color is visible through selective reflection of light defined on the basis of the observation angle.

A light selectively reflected in the color-exhibitive piece (11) is a light having a wavelength represented by the following expression (1), based on Bragg's rule and Snell's rule:

$$\lambda=2nD(\cos\theta) \qquad \text{Expression (1)}$$

where λ is the peak wavelength of structural color, "n" is the refractive index of a particle array, represented by the following expression (2), "D" is the spacing between particle layers or a particle layer spacing [in the vertical direction of a display member of microparticles (12)] as shown in FIG. 3, and "θ" is the observing angle to the perpendicular of a display member;

$$n=(na\cdot c)+[nb\cdot(1-c)] \qquad \text{Expression (2)}$$

Where "na" is the refractive index of a particle, "nb" is a refractive index of a matrix, and "c" is a volume factor of a microparticle (12) in a particle array.

Peak wavelength λ of structural color is measured by MCPD-3700 (produced by Otsuka Denshi Co., Ltd.), which is capable of recognizing the relationship between reflection light source and observation angle by using an optical fiber. The foregoing expressions (1) and (2) are each an approximate expression and there is sometimes a case which does not agree with this calculated value.

In cases when a substance filled between microparticles (12) for structural color is different from the matrix (M) forming the color-exhibitive piece (11) in the formed image, the structural color obtained in the formed image can be calculated by replacing a refractive index of the matrix (M) by that of the foregoing substance in the expression (2).

Microparticle for Structural Color

In the invention, a microparticle for structural color refers to one used to exhibit a structural color and is a substance having a particulate form capable of exhibiting a structural color in the three-dimension, which is not limited to a sphere but may be approximately in a particle form usable for structural color. This substance is preferably in a solid form but it may be in a gas form or in a liquid form when a matrix M is in a solid form and is not deformed by an external force related to fixing (for example, heat or pressure as needed when applied to a heat-fixing method). When applied to a heat-fixing method and also when the substance is in a liquid form, its boiling point is preferably greater than the heat relating to fixing.

When a microparticle (12) for structural color is in a solid form, the microparticle (12) is one which is not deformed by external forces related to fixing.

A material to form the microparticles (12) used for structural color, related to the color-exhibitive piece (11) can appropriately be chosen by a combination with a material to form a matrix (M).

Specifically, such a material to form the microparticles (12) used for structural color is required to be different in refractive index from a material to form a matrix (M) and incompatible with the material to form a matrix (M). In cases when a matrix (M) is air, a material to form the microparticles (12) is preferably one which is incompatible with a binder resin forming a fixing layer (20).

Further, a material to form the microparticles (12) for structural color is preferably one which is affinitive to a material to form a matrix (M).

Further, when applied to a heat-fixing method, a material to form the microparticles (12) for structural color is preferably a resin exhibiting a glass transition temperature (Tg) higher than the heat-treatment temperature.

There are cited a variety of examples of the microparticles (12) used for structural color, forming a color-exhibitive piece (11). Specifically, there is cited an organic particulate material formed by polymerization of a polymerizable monomer or copolymerization of polymerizable monomers selected from examples including: styrene monomers such as styrene, methylstyrene, methoxystyrene, butylstyrene, phenylstyrene and chlorostyrene; acrylic acid ester or methacrylic acid ester monomers such as methyl acrylate, ethyl acrylate, (iso)propyl acrylate, butyl acrylate, hexyl acrylate, octyl acrylate, ethylhexyl acrylate, methyl methacrylate, ethyl methacrylate, butyl methacrylate and ethylhexyl methacrylate; and carboxylic acid monomers such as acrylic acid, methacrylic acid, itaconic acid and fumaric acid.

Such a resin forming the microparticles (12) used for structural color may be one which is formed by polymerization of a crosslinking monomer, in addition to the polymerizable monomer, as cited above. Specific examples of such a crosslinking monomer include divinylbenzene, ethylene glycol dimethacrylate, tetraethylene glycol dimethacrylate and trimethylolpropane trimethacrylate.

There are also cited inorganic particles formed of an inorganic oxide, for example, silica, titanium oxide, aluminum oxide or copper oxide, or their composite oxide; glass or ceramics.

Further, there is also cited a core/shell particle comprising a core particle of an organic particle or inorganic particle, as described above and a shell layer formed of a material different from that of the core on the surface of the core particle. Such a shell layer can be formed by using metal microparticles, metal oxide microparticles such as titania or a metal oxide nano-sheet composed of titania or the like. Further, there is also cited a hollow particle obtained by removing a core from a core/shell particle through a procedure such as calcination or abstraction. Of these particles, an organic particle is suitable.

The average particle size of the microparticles (12) used for structural color is required to be set in relation to the refractive index of the microparticles (12) and that of a matrix M, and is also preferably of such a size that its dispersion is a stable colloidal solution, therefore, it is preferably from 50 to 500 nm.

When an average particle size falls within the foregoing range, the dispersion becomes a stable colloidal solution and in the obtained particle array, a structural color emitted the color-exhibitive piece (11) becomes a color exhibiting a peak wavelength in the visible. When the average particle size of the microparticles (12) is less than 50 nm, there is a concern that the color density of the visible structural color becomes less and when an average particle size of the microparticles (12) is more than 500 nm, there is a concern that increased light scattering results in milky-whitening of the structural color, rendering it difficult to recognize the structural color.

A value of coefficient of variation (hereinafter, also denoted simply as a CV value) expressing particle size distribution is preferably not more than 10(%), more preferably not more than 8(%) and still more preferably not more than 5(%). A CV value of more than 10(%) results in disorder in a particle layer to be orderly arranged and the obtained particle array becomes milky-white, rendering it difficult to perceive its structural color.

The average particle size is determined in such a manner that particles are photographed using a scanning electron microscope at a magnification of 50,000-fold (JSM-7410, produced by Nippon Denshi Co., Ltd.) and 200 particles as the microparticles (12) are measured with respect to maximum length to calculate the number average value. Herein, the maximum length refers to a maximum of distances between two points on the circumference of a microparticle (12) used for structural color. In cases when microparticles (12) are photographed as an aggregate, the maximum length of primary particles forming the aggregate (particles for structural color) is measured.

The CV value is calculated by the following expression (CV):

$$\text{CV value}(\%)=[(\text{standard deviation})/(\text{average particle size})]\times 100 \qquad \text{Expression (CV)}$$

where "standard deviation" is a standard deviation in a number-based particle size distribution and "average particle size" is a number average particle size.

The refractive index of a microparticle (12) is measured by various methods known in the art, but the refractive index in the invention is a value determined in a liquid immersion method. Examples of a refractive index of the microparticle (12) include polystyrene: 1.59, poly(methyl methacrylate9: 1.49, polyester: 1.60, fluorine-modified poly(methyl methacrylate): 1.40, poly(styrene-co-butadiene): 1.56, poly(methyl acrylate): 1.48, poly(butyl acrylate): 1.47, silica: 1.45, titanium dioxide (anatase type): 2.52, titanium dioxide (rutile type): 2.76, copper oxide: 2.71, aluminum oxide: 1.76, barium sulfate: 1.64 and ferric oxide: 3.08.

The microparticles (12) forming the particle layer (15) for structural color may be a single material having a single composition or a composite material, and may be particles for structural color, having a substance capable of adhering other microparticles for structural color on the particle surface or having introduced a substance capable of adhering other microparticles for structural color into the interior of the particle. Accordingly, the use of such an adhesive substance enables allowing particles used for structural color to be adhered to each other, even in cases where particles used for structural color may be a substance which is difficult to be self-arranged when forming a particle layer (15) for structural color. When forming particles for structural color with a material of a high refractive index, there may be added internally a substance of a low refractive index.

Microparticles (12) forming the microparticle layer (15) for structural color are preferably those of enhanced monodispersibility, which are readily orderly arranged. In cases when the particles are those of an organic material, to achieve enhanced monodispersibility, the particles are preferably made by a soap-free emulsion polymerization method, a suspension polymerization method or an emulsion polymerization method, as known in the art.

The microparticles (12) may be subjected to a various surface treatments to achieve enhanced affinity to a matrix (M).

Matrix

A matrix (M) forming a color-exhibitive piece (11) may be in a gas form or in a solid form. When a matrix (M) is in a solid form, an obtained color-exhibitive piece (11) exhibits enhanced strength, capability of preventing particles for structural color from being released and flexibility.

Figure 4:
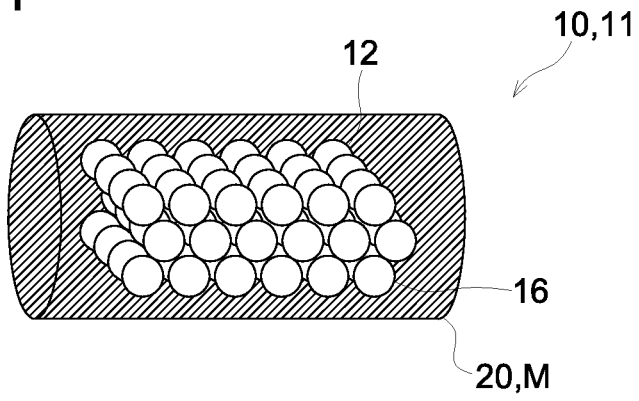
FIG. 4 illustrates a schematic perspective view showing another example of the structure of a color particle used in the invention.

A material to form a matrix (M) may be a substance which is different from the binder resin forming a fixing layer (20) of a color particle (10), or may be an identical substance, in which an area between microparticles (12) of a color-exhibitive piece (11) is a fixing layer (20), as shown in FIG. 4. Such a substance differing from the binder resin preferably is not compatible with the binder resin forming a fixing layer (20).

A matrix (M) in a solid form may appropriately choose a material to form the matrix (M) which differs in refractive index from the microparticles (12). Such a material to form the matrix (M) preferably is one which exhibits enhanced affinity to the microparticles (12).

Further, the material to form a matrix (M), which is a substance differing from the binder resin forming a fixing layer (20) and is applied to a heat-fixing method, may be one which is fusible in a heating process related to fixing or one which is non-fusible.

Further, in cases when a matrix (M) is in a solid form and the microparticles (12) are in a gas or liquid form, the matrix (M) is to be one which is not deformed by heat related to fixing or appropriately applied pressure.

The refractive index of a matrix (M) in a solid form can be determined by various methods known in the art. In the invention, the refractive index of a matrix (M) is a value obtained in such a manner that a thin film which is composed of the matrix (M) alone is prepared and subjected to measurement using an Abbe's refractometer. Specific examples of a refractive index of a matrix include silicon gel: 1.41, gelatin/arabic gum: 1.53, polyvinyl alcohol: 1.51, poly(sodium acrylate):

1.51, fluorinated acryl resin: 1.34, poly(isopropyl acrylamide): 1.51 and acryl resin foam: 1.43.

Examples of a material to form a matrix (M) in a solid form include a resin, a hydro-gel, an oil-gel, a photo-curing agent, a thermo-curing agent and a moisture-curing agent. Specific examples of a hydro-gel include a gel obtained by mixing a gelling agent such as gelatin, carraginan, polyacrylic acid or poly(sodium acrylate) with water; and specific examples of an oil-gel include a silicone gel or flyorinated silicone gel, and a gel obtained by mixing a gelling agent such as amino acid derivatives, cyclohexane derivatives or polysiloxane derivatives with a silicone oil or an organic solvent.

Preparation Method of Color-Exhibitive Piece

A color exhibitive-piece (11) is prepared, for example, in such a manner, as bellow. An aqueous dispersion of microparticles (12) used for structural color was prepared, coated on the surface of a substrate and allowed to self-arranged and then dried to form a periodic structure 16 having the microparticles (12) arranged in a regular order; thereafter, a solution to form a matrix (M) is coated on the periodic structure (16) to be filled with no space between the microparticles (12) and is solidified, which is peeled from the substrate to obtain a large piece of a color-exhibitive film; the thus obtained large piece is pulverized and classified to obtain the color-exhibitive piece 11.

The substrate can employ, for example, rubber, glass, ceramics, or a film or sheet of polyethylene terephthalate (PET) or polyethylene naphthalate (PEN). When preparing a color-exhibitive piece (11) by using an aqueous dispersion of microparticles (12), it is preferred to employ a substrate with a surface exhibiting a low contact angle for water. The substrate may be appropriately subjected to a surface treatment in view of enhanced surface smoothness being preferred. The substrate may also be subjected to a blasting treatment so that the microparticles (12) easily adhere.

Coating of an aqueous dispersion of the microparticles (12) for structural color may employ a screen coating method, a dip coating method, a spin-coating method, a curtain coating method, or a Langmuir-Blodgett (LB) membrane forming method.

There may be used, for example, Hammer Mill (produced by Hosokawamicron Co., Ltd. or Turbo Mill Type T-400 (produced by Turbo Kogyo Co., Ltd.) for pulverization of large pieces of color-exhibitive film. There may also be used a wind power classifier for classification. Thereby, a color-exhibitive piece with an intended fineness ratio can be obtained.

Fixing Layer

In the color particle (10) used for image formation of the invention, a fixing layer (20) contains at least a binder resin. Such a binder resin forming the fixing layer (20), when applied to a heat-fixing method, exhibits a softening temperature (Tsp) lower than the temperature of the heating treatment.

Examples of a binder resin used for the fixing layer (20) include various thermo-plastic resins known in the art, such as a vinyl resin, e.g., styrene resin, (meth)acryl resin, styrene-(meth)acryl copolymeric resin or olefinic resin; a polyester resin, a polyamide resin, a polycarbonate resin, polyether, a poly(vinyl acetate) resin, a polysulfone resin, and a polyurethane resin. Specifically to achieve enhanced transparency is preferred a styrene resin, an acryl resin or a polyester resin, which exhibits enhanced transparency and superior melting characteristic such as sharp-melting property at a relatively low viscosity. These resins may be used singly or in combination.

The content of a binder resin is preferably from 50 to 1000 of the fixing layer (20). When the content of a binder resin in the fixing layer is less than 50%, thermal deformation of the binder resin is inhibited in heat-fixing, resulting in a lowering of fixability and possibly leading to defects of the formed image.

The softening temperature (Tsp) of a binder resin is preferably within a range of 70 to 140° C. when applied to a heat-fixing method.

The softening temperature (Tsp) of a binder resin can be determined in the following manner.

Under an environment of 20±1° C. and 50±5% RH, 1.1 g of a binder resin are placed into a petri dish and leveled off. After being allowed to stand for at least 12 hrs., they are compressed for 30 sec. under a force of 3820 kg/cm$^2$ using a molding device SSP-A (produced by Shimazu Seisakusho) to prepare a cylindrical molded sample of a 1 cm diameter. Using a flow tester CFT-500D (produced by Shimazu Seisakusho) under an environment of 24±5° C. and 50±20%, the prepared sample was extruded through a cylindrical die using a piston of 1 cm diameter after completion of pre-heating under conditions of a load weight of 196 N (29 kgF), at an initial temperature of 60° C., a pre-heating time of 300 sec. and temperature-raising rate of 6° C./min. An offset method temperature ($T_{offset}$), which is determined at an offset value of 5 mm in a melting temperature measurement method (temperature-raising method), is defined as the softening point in the invention. The $T_{offset}$ refers to the temperature determined in the offset method.

In a binder resin related to the invention, the number average molecular weight (Mn), which is determined in gel permeation chromatography (GPC), is preferably within the range of from 3,000 to 6,000, and more preferably from 3,500 to 5,500; the ratio (Mw/Mn) of weight average molecular weight (Mw) to number average molecular weight (Mn) is preferably within a range of from 2.0 to 6.0, and more preferably from 2.5 to 5.5; and the glass transition temperature (Tg) is preferably within a range of from 40 to 70° C., and more preferably from 45 to 65° C.

Determination of molecular weight by GPC is performed in the following manner. Using an apparatus, HLC-8220 (produced by TOSO Co., Ltd.) and a column, TSK guard column TSK gel Super HZM-M three-stranded (produced by TOSO Co., Ltd.), tetrahydrofuran (THF) as a carrier solvent is allowed to flow at a flow rate of 0.2 ml/min, while maintaining a column temperature at 40° C. A binder resin is dissolved in tetrahydrofuran (THF) at room temperature, while being stirred over 5 min. by an ultrasonic homogenizer to obtain a solution at a concentration of 1 mg/ml. Subsequently, the solution is filtered with a membrane filter having a pore size of 0.2 μm to obtain a sample solution. Into the apparatus was injected 10 μl of the obtained sample solution together with the foregoing carrier solvent and detected by using a refractive index detector (RI detector). The molecular weight distribution of a sample is determined by use of a calibration curve which was prepared by using monodisperse polystyrene standard particles to determine the molecular weight. Standard polystyrene samples used for preparation of a calibration curve employ those of molecular weights of $6\times10^2$, $2.1\times10^3$, $4\times10^3$, $1.75\times10^4$, $5.1\times10^4$, $1.1\times10^6$, $3.9\times10^5$, $8.6\times10^5$, $2\times10^6$ and $4.48\times10^6$, produced by Pressure Chemical Co. A calibration curve is prepared using at least ten of these standard polystyrene samples. A refractive index detector is used as a detector.

The glass transition point temperature (Tg) can be measured using DSC-7 differential scanning colorimeter (produced by Perkin-Elmer Corp.) or TAC7/DX thermal analysis controller (produced by Perkin-Elmer Corp.). The measurement is conducted as follows. A binder resin of 4.5-5.0 mg is precisely weighed to two places of decimals, sealed into an aluminum pan (KIT No. 0219-0041) and set into a DSC-7 sample holder. An empty aluminum pan is used as a reference. The temperature was controlled through heating-cooling-heating at a temperature-raising rate of 10° C./min and a temperature-lowering rate of 10° C./min in the range of 0 to 200° C. An extension line from the base-line prior to the initial rise of the first endothermic peak and a tangent line exhibiting the maximum slope between the initial rise and the peak are drawn and the intersection of both lines is defined as the glass transition point.

The fixing layer (20) used for an image forming method of the invention may contain a wax, colorant or the like other than the binder resin.

A wax to be contained in the fixing layer (20) is not specifically limited and various kinds of waxes are usable. When applied to a heat-fixing method, the melting point of the wax, depending on the temperature in a heating treatment of the image forming method, is preferably from 60 to 100° C., and more preferably from 65 to 85° C. The melting point of a wax refers to the temperature at the endothermic peak, which is determined in differential scanning calorimetry using a differential colorimeter, DSC-7 (produced by Perkin Elmer Co.) and a thermal analysis controller, TACT/DX (also produced by Perkin Elmer Inc.).

Specifically, 4.5 mg of wax is placed into an aluminum pan (kit No. 0219-0041), which is set to a sample holder DSC-7. Temperature control of Heat-Cool-Heat is performed at temperature-increasing rate of 10° C./min and a temperature-decreasing rate of 10° C./min within a measurement temperature range and analysis is made based on the data obtained in the 2nd "Heat". Reference measurement is performed using an empty aluminum pan.

A wax is contained preferably in an amount of from 1 to 30% by mass of the fixing layer (20), and more preferably from 5 to 20% by mass. A wax content falling within the foregoing range results in an image (25, FIG. 6*b*) of uniform and enhanced gloss.

A colorant to be contained in the fixing layer (20) is not specifically limited and may employ various kinds of dyes and pigments known in the art. A colorant is contained in the fixing layer (20), preferably in an amount of from 0 to 10% by mass. A colorant content of more than 10% by mass causes liberation of the colorant in the obtained color particle, often adversely affecting electrification property.

The fixing layer (20) used for the image forming method of the invention is a translucent one.

Preparation Method of Color Particle

The preparation method of a color particle (10) is not specifically limited and, for example, a cylindrical color particle is prepared as below.

Figure 5A:
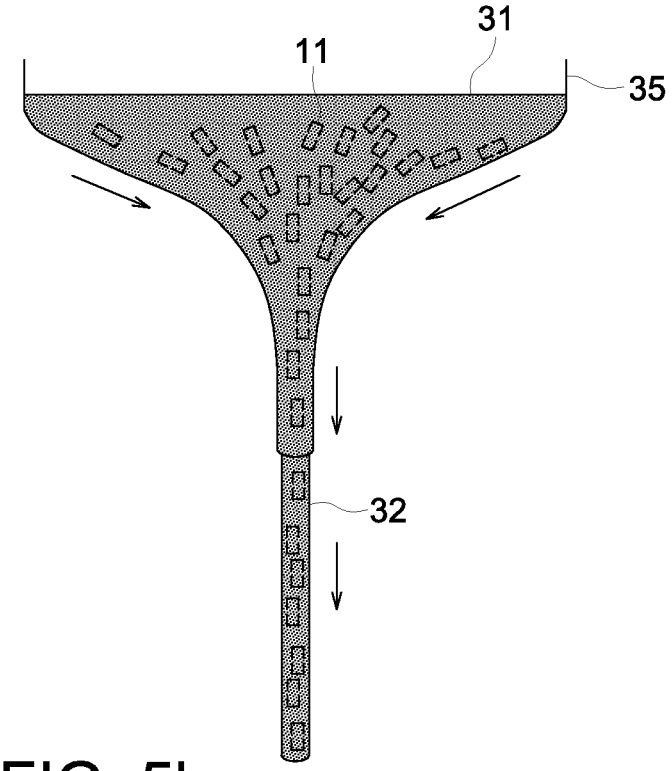
FIGS. 5*a* and 5*b* illustrates an example of a production method of color particles usable in the invention.
Figure 5B:
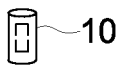

First, as shown in FIG. 5*a*, a particle raw material (31) which was prepared by mixing color-exhibitive pieces (11), a binder resin and other appropriate constituent materials are melt-kneaded and continuously extruded through a nozzle to form a color-exhibitive fiber (32) in a fibrous form. This color-exhibitive fiber (32) is mechanically cut or ground to obtain a powder. The thus obtained powder is subjected to classification, whereby a cylindrical color particle (10), as shown in FIG. 5*b* is prepared.

A color particle (10) in which a color-exhibitive piece (11) has an included angle falling within the afore-described range, can be readily obtained according to the preparation method described above. The reason for this is assumed to be that the particle raw material (31) which has been melt-kneaded and becomes fluid is supplied to a nozzle (35). While being conveyed to the top of the nozzle (35) by fluidity of the particle raw material (31), the color-exhibitive piece (11) is aligned by its anisotropy so that its longitudinal direction is aligned along the formation direction of the color-exhibitive fiber (32) and the color-exhibitive piece (11) is extruded from the top of the nozzle (35), while maintaining such a state. Factors to control the angle of the longitudinal direction of the color-exhibitive piece (11) to the major axis direction of the color particles (10) so as to fall within a range of ±20° include, for example, ratio of major axis to minor axis, diameter or length of the nozzle, as shown in FIG. 5*a*, viscosity of the binder resin, mixing ratio of a binder resin and color-exhibitive pieces, flow rate of the mixture within the nozzle, and the like.

Mixing of the particle raw material (31) is performed without any special restriction, using conventional mixers such as a V-type mixer, a rocking mixer, a Loedige mixer, a Nauta mixer, a Henschel mixer or the like.

Melt-kneading of the particle raw material (31) is performed, without any special restriction, using a single-screw or twin-screw kneader, or a batch type kneader by a roll mill. It is important to conduct melt-kneading under appropriate conditions so that the molecular chain of the binder resin is not cleaved. Specifically, melt-kneading is conducted preferably at a temperature with reference to the softening temperature (Tsp) of the binder resin.

Formation of a color-exhibitive fiber (32) from a melt-kneaded particle raw material (31) is performed in such a manner that, as shown in FIG. 5*a*, a melt-kneaded particle raw material (31) which is melted and fluid is conveyed to a nozzle (35) and is continuously extruded from the top of the nozzle (35). When conveyed to the nozzle (35), the melt-kneaded particle raw material (31) may be supplied to the nozzle (35) with maintaining a melting state, or may be cooled once, heated again and then supplied to the nozzle (35) in a fluid state.

The diameter of the nozzle (35) may be such a size that the obtained color fiber (32) has a wire diameter which is identical to the minor axis diameter (B) of a color particle (10).

A smaller nozzle diameter requires a higher pressure necessary for extrusion from the nozzle and it is further necessary to lower the viscosity of a melt-kneaded particle raw material to perform efficient extrusion from the nozzle, resulting in a lowering of productivity. Accordingly, the nozzle diameter may be larger than the minor axis diameter of the formed color particle, for example, from 100 to 500 μm and the thus obtained thick color fiber may be subjected to a stretching treatment to form a color fiber having a wire diameter which is identical to the minor axis diameter.

Such a stretching treatment is not specifically limited but a method to perform stretching by air blown from an air-blower for stretch, while extruding a particle raw material from a nozzle is preferred in terms of control of the wire diameter and productivity. Specifically, using "Spinning Blown Apparatus" (produced by Nippon Nozzle Co., Ltd.), a melt-kneaded particle raw material (31) is conveyed to a gear pump within the apparatus, while maintaining the melted state, continuously extruded through some hundreds nozzles of 170 μm diameter and stretched to the intended wire diameter by using hot air blown by an air blower for stretching installed around the nozzles, whereby a color fiber is obtained.

In the step of mechanically cutting or grinding the thus obtained color fiber 32, it is preferred to cut or grind the color fiber (32) to the intended size after the color fiber (32) is appropriately cooled, preferably to a temperature lower than the softening temperature (Tsp) of the binder resin, and more preferably to a temperature lower by at least 10° C. than the softening temperature (Tsp).

A means for cutting the color fiber (32) preferably employs a method in which the fiber is sequentially and continuously cut by a high-speed rotating blade having a rotating shaft provided with plural cutting blades. Using such a cutting means, the major axis diameter (A) of the obtained color particles (10) can be readily controlled by controlling the circumferential speed of the rotating blade. Thereby, it is easy to achieve enhanced uniformity of the major axis diameter (A) of the obtained color particles (10) and it is also less likely to generate fine powder.

A means for grinding the color fiber (32) may employ conventional grinding means, and there are preferably employed, for example, a method of performing grinding by collision on a collision board in a jet airflow, or a technique of performing grinding in a narrow gap between a mechanically rotating rotor and a stator. The color fiber (32) is fibrous and is easily ground, enabling it easy to achieve enhanced uniformity of the major axis diameter of the color particle (10).

A powdery material obtained by cutting or grinding the color fiber (32) is subjected to classification to remove fine powder, whereby color particles (10) are obtained. Classification methods include, for example, a method of classifying a powdery material in an airflow by a centrifuge power.

Image Forming Method

Figure 6B:
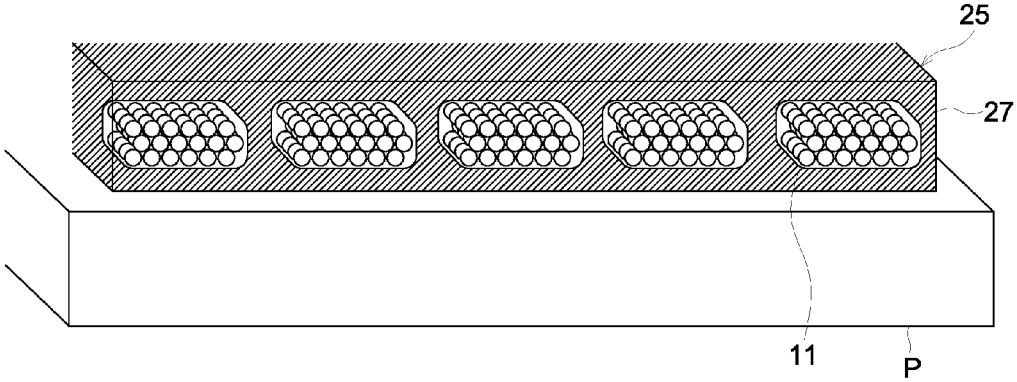

FIGS. 6*a* and 6*b* illustrate the case of employing a heat-fixing method, as an example of an image forming method of the invention. This image forming method comprises an image forming step of electrostatically forming a particle image (23) on an image support (P) and a heat-fixing step of fixing the particle image (23) on the image support (P) by a heating process to form a fixer layer (27) containing a binder resin of a fixing layer (20) forming the color particle (10), whereby an image is obtained.

The image (25) is not limited only to all of color-exhibitive pieces (11) being buried in the fixer layer (27) but the individual color-exhibitive pieces (11) may be fixed in a state of not being separated from the image support (P), while maintaining enhanced directional uniformity.

In the image forming method of the invention, color particles (10) are contained in an amount of 70 to 100% by mass of a material forming the particle image (23). Materials usable to form the particle image (23) together with the color particles (10) include, for example, a clear toner not containing a color-exhibitive piece or a colorant and a conventional toner which does not contain a color-exhibitive piece but contains a colorant.

Particle Image Forming Step

In the particle image (23) obtained in the particle image forming step, color particles (10) are arranged along the surface of the image support (P) according to anisotropy of the color particle (10), resulting in enhanced uniformity of the fixing direction. Accordingly, enhanced uniformity of the fixing direction of color-exhibitive pieces (11) is also achieved. In the invention, the fixing direction refers to any direction extending across the surface direction of the image support (P). In the invention, the direction of the individual color-exhibitive piece (11) extending in the longitudinal direction across the face direction may not be along with the fixed direction.

In the particle image forming step, a method of electrostatic-forming the particle image (23) on the image support (P) may employ various methods known in the art, including, for example, a method in which an electrostatic latent image is formed on a photoreceptor by an electrophotographic process and transferred onto the image support (P) and a method in which color particles (10) and a fixing layer (20) are charged by using a spray gun and electrostatically coated onto an earthed material to be coated.

Heat-Fixing Step

A heating treatment in the heat-fixing step may employ various methods known in the art without special restriction, including, for example, heat-roller fixing in an electrophotographic system. The temperature in the heating treatment may be a temperature higher than the softening temperature (Tsp) of a binder resin forming the fixing layer (20), which is, for example, from 100 to 250° C.

In the heat-fixing step, there may be provided external stimulation such as pressure light exposure or the like, in addition to heating, without deforming the microparticles (12) for structural color and the color-exhibitive piece and without lowering their structural coloring.

Image Support

Examples of the image support (P) usable in the image forming method of the invention include plain paper including light and heavy paper, fine-quality paper, coated paper for printing, such as art paper or coated paper, commercially available Japanese paper or a post card, plastic film used for OHP and cloth, but are not limited to these.

In the image forming method of the invention, a color particle which contains a color-exhibitive piece exhibiting a structural color inclined at a specific angle and exhibits anisotropy, is used, whereby enhanced uniformity in the fixing direction of the color-exhibitive piece is achieved in the obtained image, wherein different colors are visible depending on the viewing angle, and there can be formed an image in which a specific color is visible at a specific angle.

While the embodiments of the invention have been described in detail, it will be apparent to one skilled in the art that various changes and modifications can be made therein.

EXAMPLES

The present invention is described specifically with reference to examples but is by no means limited thereto. In the following, the average particle size and the CV value of microparticles used for structural color, the thickness of toner particles in the planar direction, measurement of major axis or minor axis of a color particle and a color-exhibitive piece, and an included angle of a color particle are determined similarly to the method described earlier. In Examples, "part(s)" represents part(s) by mass, unless otherwise noted.

Synthesis Example 1 of Microparticles for Structural Color

A mixture of 72 parts by mass of styrene, 20 parts by mass of n-butyl acrylate and 8 parts by mass of acrylic acid was heated to 80° C. to prepared a monomer mixture solution. Further, 0.2 part by mass of sodium dodecylsulfonate was dissolved in 163 parts by mass of deionized water at 80° C. to obtain a surfactant solution. The monomer mixture solution and the surfactant solution were mixed and stirred for 30 min. by a mechanical dispersing machine, CLEARMIX (produced by M TECHNIQUE Co., Ltd.) to prepare an emulsified dispersion. To a reaction vessel equipped with a stirring device, a heating and cooling device, a nitrogen introducing device and a charger for raw material or an auxiliary agent were added to the foregoing emulsified dispersion and an aqueous surfactant solution of 0.1 g of sodium dodecylsulfonate dissolved in 142 parts by mass and the internal temperature was raised to 80° C. with stirring at 200 rpm under a stream of nitrogen. To this solution were 1.4 parts by mass of potassium persulfate and 54 parts by mass of water to perform polymerization over 3 hrs., whereby a dispersion of microparticles was obtained. The thus obtained microparticle dispersion was subjected to centrifugal separation by using a centrifugal separator to separate relatively large particles from relatively small particles, whereby a dispersion (1) of spherical microparticles, exhibiting a relatively high mono-dispersibility was obtained. It was proved that microparticles (1) for structural color of the dispersion (1) exhibited an average particle size of 250 nm and a CV value of 5.

Preparation of Color-Exhibitive Piece (1)

The foregoing dispersion (1) was coated on a washed glass plate by a bar-coating method and dried under an environment at a temperature of 20° C. and a humidity of 50% RH to form a periodic structure with a thickness of 20 μm and an area of 100×100 $cm^2$. The formed periodic structure was peeled from the glass plate and pulverized by using a pulverizer, TURBO-MILL (produced by TURBO Kogyo Co., Ltd.) at 15,000 rpm and then, classification was conducted by an air classifier employing the Coanda effect to obtain a color-exhibitive piece (1) having a major axis diameter of 30 μm and minor axis diameter of 5 μm.

Preparation of Color-Exhibitive Pieces (2)-(8):

Color-exhibitive pieces (2) to (8), as shown in Table 1, were prepared in the same manner as in the foregoing preparation of color-exhibitive piece (1), except that pulverization conditions were appropriately varied.

TABLE 1

| Color-Exhibitive Piece No. | Major Axis Diameter (μm) | Minor Axis Diameter (μm) |
|---|---|---|
| 1 | 30 | 5 |
| 2 | 65 | 15 |
| 3 | 15 | 3 |
| 4 | 25 | 5 |
| 5 | 30 | 5 |
| 6 | 50 | 15 |
| 7 | 10 | 5 |
| 8 | 30 | 5 |

Production of Color Particle (1):

(1) Preparation of Binder Resin:

In xylene were dissolved 50 parts by mass of A-component composed of styrene exhibiting a maximum value of molecular weight of 3,600 and a glass transition temperature of 62° C., B-component composed of 73 parts by mass of styrene, 25 parts by mass of n-butyl acrylate and 2 parts of acrylic acid, exhibiting a maximum value of molecular weight of 100,000 and a glass transition temperature of 52° C., and C-component composed of 80 parts by mass of styrene and 20 parts by mass of n-butyl acrylate, exhibiting a maximum value of molecular weight of 600,000 and a glass transition temperature of 60° C. The prepared resin solution was dried under reduced pressure to obtain styrene-acryl resin (1).

(2) Granulation:

| | |
|---|---|
| Resin: styrene-acryl resin (1) | 100 parts |
| Color exhibitive piece: Color exhibitive piece (1) | 10 parts |
| Releasing agent: natural Fischer-Tropsch wax (melting point: 100° C.) | 4 parts |

Material group C composed of the foregoing materials was mixed by a Henschel mixer over 20 min. and then kneaded at 115° C. in a twin-screw kneader to obtain a melt-kneaded mixture. The obtained mixture was conveyed into Spinning Blown Apparatus (produced by Nippon Nozzle Co., Ltd.) and continuously extruded through a nozzle having a nozzle diameter of 170 μm. The thus extruded mixture was fabricated by hot air to a fiber form having a line diameter of 5.6 μm. The obtained fibrous melt-kneaded material was pulverized using a pulverizer of a collision plate system by a jet mill, I-Type Mill (produced by NIPPON PNEUMATIC CO., LTD.) and classified by a multi-divided classifying apparatus, Elbow-Jet Classifier (Nittetsu Kogyo Co., Ltd.). Pulverized particles were successively measured with respect to major axis diameter and minor axis diameter, in which pulverizing and classifying conditions were appropriately controlled so that the major axis diameter and the minor axis diameter were 40 μm and 10 μm, respectively. Thereby, a toner (1) comprised of color particles (1) having a major axis diameter of 40 μm and a minor axis diameter of 10 μm was obtained.

The included angle of the color-exhibitive piece (1) in the color particle (1) was measured and was shown to be 5°.

Production of Color Particles (2)-(7):

Color particles (2)-(7) were each produced in the same manner as in the color particle (1), except that the color-exhibitive piece (1) was replaced by each of color-exhibitive pieces (2)-(7), as shown in Table 1 and pulverization condition, classification condition and flow rate within the nozzle of the Spinning Blown Apparatus were appropriately varied. Thereby, toners (2)-(7) were obtained from the color particles (2)-(7).

Production of Color Particle (8):

A color particle (8) in which an angle of the major axis of a color-exhibitive piece to the major axis of the color particle was 25 degrees, was produced in the same manner as in the color particle (1), except that the nozzle diameter of Spinning Blown Apparatus was varied to 500 μm. Thereby, toner (8) was obtained from the color particle (8).

Production Example (1) of Interference Pigment Toner

In accordance with Examples disclosed in Japanese Patent Application JP 2002-3511144A, there was obtained an interference toner (x) comprised of a mixture of 45 g of a angle-dependent, pearly luster pigment (color effect of bluish green/violet) and 5 g of a dry toner, Ultra Magnefine (trademark, produced by Panasonic Co., Ltd.).

Production Example (2) of Interference Pigment Toner

In 10,000 parts by mass of toluene were dissolved 800 parts by mass of styrene and 200 parts by mass of acrylonitrile and 3 parts by mass of AIBN (azobisisobutylonitrile) was added thereto. After azodicarbonamide having a volume average particle size of 5 μm was further added in an amount of 50% by mass and dispersed, polymerization was performed to obtain binder resin (Y).

To 110 parts by mass of the binder resin (Y) were added 1 part by mass of stearic acid, 2 parts by mass of polypropylene and 15 parts by mass of Pale Gold (average particle size: 20 μm) which were surface treated with silica to obtain a mixture. Using a twin-screw extruding melt-kneader (having seven temperature control cylinders and one vent), the mixture was kneaded at a resin temperature of 130° C. to the 5th cylinder, degassed at 150° C. in the 6th cylinder provided with the vent and was foamed at 180° C. in the 7th cylinder, whereby a sponge-form kneaded material was obtained.

The kneaded material was pulverized by a jet mill (under a pressure of 0.5 MPa) and classified by a pneumatic classifier, whereby a parent toner (y) having a volume average particle size of 7 μm was obtained at a yield of 50%. To 98.6 parts by mass was added 1.4 parts by mass of fine hydrophobic silica particles and mixed, whereby an interference pigment toner (y) was obtained.

To 7 parts by mass of each the toners (1) to (8) and interference toners (x) and (y) was added 93 parts by mass of an acryl-coated ferrite carrier to obtain color developers (1) to (8), (x) and (y).

Examples 1-5 and Comparative Examples 1-5

Using each of the color developers (1) to (8), (x) and (y) in a copier Bizhub C 650 (produced by Konica Minolta Business Technologies Inc.), a half-tone image was formed at a toner picture element ratio of 300. The formed image was visually observed at an angle of 45° from the vertical direction to the image and at a distance of 30 cm from the image by five randomly chosen observers, and evaluated with respect to visibility of a specific single color, based on the following criteria.

A: A specific single color being visible in all portions of the image area,

B: A specific single color being visible in almost all portions of the image area but another color being observed in some portions, C: Color unevenness being largely observed and a specific single color being difficult to be observed.

The evaluation result was judged based on the criterion of the most of the numbers of the observers. It was evaluated that only the rank "A" was acceptable in practice and other ranks were unacceptable. Evaluation results are shown in Table 2.

TABLE 2

| | Toner | | | | | | |
|---|---|---|---|---|---|---|---|
| | | Color-exhibitive Piece | | Shape | | | |
| | No. | No. | Included Angle (degree) | Major Axis Diameter (A) | Minor Axis Diameter (B) | A/B | Evaluation |
| Example No. 1 | 1 | 1 | 5 | 37 | 15 | 2.5 | A |
| Example No. 2 | 2 | 2 | 5 | 72 | 15 | 4.8 | A |
| Example No. 3 | 3 | 3 | 10 | 22 | 15 | 1.5 | A |
| Example No. 4 | 4 | 4 | 0 | 32 | 15 | 2.1 | A |
| Example No. 5 | 5 | 5 | 20 | 37 | 20 | 1.9 | A |
| Comp. 1 | 6 | 6 | 10 | 57 | 10 | 5.7 | B |
| Comp. 2 | 7 | 7 | 5 | 17 | 15 | 1.1 | C |
| Comp. 3 | 8 | 8 | 25 | 37 | 15 | 2.5 | C |
| Comp. 4 | x | — | — | — | — | — | C |
| Comp. 5 | y | — | — | — | — | — | C |

What is claimed is:

1. A color particle, comprising:

a color-exhibitive piece which comprises microparticles for structural color and a matrix, the microparticles being in a periodic structure in the matrix; and the color-exhibiting piece is dispersed in a binder resin, wherein the color particle meets the following requirement:

$$1.5 \leqq A/B \leqq 5.0$$

wherein A is a major axis diameter of the color particle and B is a minor axis diameter of the color particle; and an angle of a longitudinal direction of the color-exhibitive piece to a major axis direction of the color particle falls within a range of ±20 degrees.

2. The color particle of claim 1, wherein the major axis diameter of the color particle is from 1 to 100 μm.

3. The color particle of claim 1, wherein the color particle contains the color-exhibitive piece in an amount of 0.1 to 50% by mass.

4. The color particle of claim 1, wherein the color-exhibitive piece has a major axis diameter (a) of 1 to 75 μm and a minor diameter (b) of 0.5 to 50 μm.

5. The color particle of claim 1, wherein the binder resin contains a colorant.

6. An image forming method comprising forming an image by using a color particle comprising a color-exhibitive piece which comprises microparticles for structural color and a matrix and is dispersed in a binder resin, wherein the color particle meets the following requirement:

$$1.5 \leqq A/B \leqq 5.0$$

wherein A is a major axis diameter of the color particle and B is a minor axis diameter of the color particle; and an angle of a longitudinal direction of the color-exhibitive piece to a major axis direction of the color particle falls within a range of ±20 degrees.

7. The image forming method of claim 6, wherein the major axis diameter of the color particle is from 1 to 100 μm.

8. The image forming method of claim 6, wherein the color particle contains the color-exhibitive particle in an amount of 0.1 to 50% by mass.

9. The image forming method of claim 6, wherein the color-exhibitive piece has a major axis diameter (a) of 1 to 75 μm and a minor diameter (b) of 0.5 to 50 μm.

10. The image forming method of claim 6, wherein the binder resin contains a colorant.

* * * * *